United States Patent [19]

Arai et al.

[11] Patent Number: 4,734,547

[45] Date of Patent: Mar. 29, 1988

[54] REVERSING SPEED CONTROL SWITCH

[75] Inventors: Hiroyuki Arai; Touru Kasai, both of Kawasaki, Japan

[73] Assignee: Fujisoku Electric Co., Ltd., Kawasaki, Japan

[21] Appl. No.: 7,340

[22] Filed: Jan. 27, 1987

[30] Foreign Application Priority Data

Aug. 5, 1985 [JP] Japan ..... 60-119313

[51] Int. Cl.[4] ..... H01H 9/00; H01H 21/00

[52] U.S. Cl. ..... 200/1 V; 200/11 K; 200/157

[58] Field of Search ..... 200/1 V, 5 R, 11 R, 200/11 G, 11 J, 11 K, 14, 157, 291; 310/47, 50, 68 A; 318/345 R

[56] References Cited

U.S. PATENT DOCUMENTS

| | | | |
|---|---|---|---|
| 3,260,827 | 7/1966 | Frenzel | 200/157 |
| 3,543,120 | 11/1970 | Robertson | 318/345 R |
| 3,590,194 | 6/1971 | Frenzel | 200/157 |
| 3,591,740 | 7/1971 | Kolster | 200/11 J |
| 3,632,936 | 1/1972 | Piber | 200/1 V X |
| 3,755,640 | 8/1973 | Kaman et al. | 200/1 V X |
| 4,097,704 | 6/1978 | Piber | 200/1 V X |
| 4,100,383 | 7/1978 | Piber | 200/1 V X |
| 4,231,310 | 11/1980 | Muramatsu | 200/157 X |
| 4,523,115 | 6/1985 | Cuneo | 200/1 V X |
| 4,587,384 | 5/1986 | Yacobi | 200/1 V |
| 4,590,344 | 5/1986 | Kikta et al. | 200/291 |

FOREIGN PATENT DOCUMENTS

| | | |
|---|---|---|
| 47-28478 | 11/1972 | Japan . |
| 49-58320 | 6/1974 | Japan . |
| 55-106927 | 7/1980 | Japan . |
| 57-78722 | 5/1982 | Japan . |
| 59-158240 | 10/1984 | Japan . |
| 59-187037 | 12/1984 | Japan . |

*Primary Examiner*—J. R. Scott

*Attorney, Agent, or Firm*—Ladas & Parry

[57] ABSTRACT

Disclosed is a reversing speed control switch. This control switch has a trigger arranged on a casing, a movable element which is moved upon operation of the trigger, a power switch for switching, on and off, a power source to be interlocked with the operation of the movable element, a reversing switch, connected to the switch, for switching the polarity of the power source, a reversing actuator whose shaft portion coupled to the reversing switch is located in the central portion the casing, and whose actuation portion is located outside the casing, and a speed control circuit for performing speed control, upon operation of the trigger. The movable element, the switch, and the speed control circuit are arranged around the shaft portion.

5 Claims, 14 Drawing Figures

REVERSING SPEED CONTROL SWITCH

BACKGROUND OF THE INVENTION

The present invention relates to a reversing speed control switch which is applied to, for example, an electrical tool, and which can change the rotating direction and rotating speed of a motor.

Known switches capable of changing the rotating direction and rotating speed of a motor are described in U.S. Pat. Nos. 4,100,383, 4,097,704, and 3,755,640. However, in these switches, a reversing switch mechanism for reversing the rotating direction of the motor and a switch mechanism for turning on and off a power source, are arranged vertically. Thus, a space between the respective parts is widened, resulting in a large-sized switch. Since the reversing switch mechanism is separated from the power switch mechanism, it is difficult to achieve electrical connection therebetween.

SUMMARY OF THE INVENTION

It is an object of the present invention to provide a compact reversing speed control switch which can change the rotating direction and speed of a motor, and which can be easily assembled.

In order to realize the present invention, there is provided a reversing speed control switch comprising a casing; actuation means arranged on the casing; movable means which is arranged in the casing, and which is moved upon actuation of the actuation means; power switch means, arranged in the casing, for switching, on and off, a power source to be interlocked with the operation of the movable means; reversing switch means, connected to the power switch means, for switching the polarity of the power source supplied there from; reversing actuation means whose shaft portion, coupled to the reversing switch means, is arranged in the central portion of the casing, and whose actuation portion is arranged outside the casing; and speed control means, connected to the reversing switch means and power switch means, for performing speed control upon actuation of the actuation means, wherein the movable means, the power switch means, and speed control means are arranged around the shaft portion.

DETAILED DESCRIPTION OF THE PREFERRED EMBODIMENTS

An embodiment of the present invention will now be described, with reference to the accompanying drawings.

Figure 1:
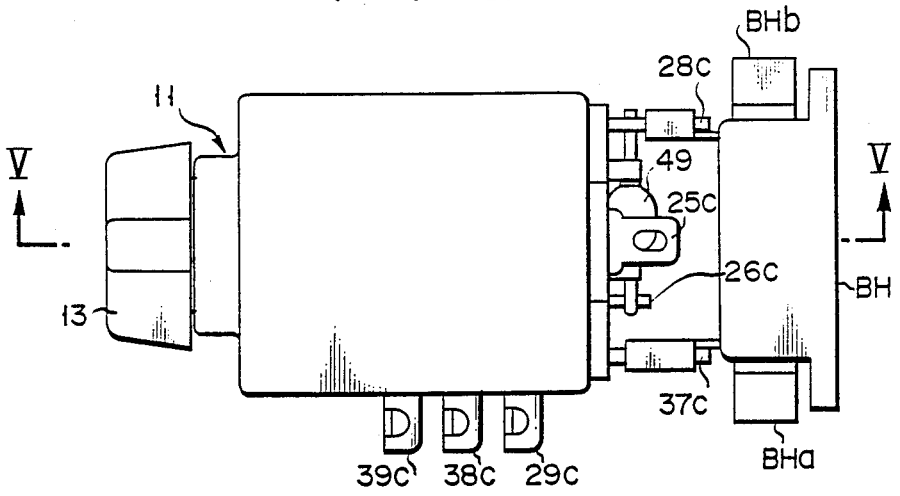
FIG. 1 is a plan view showing a first embodiment of a reversing speed control switch.
Figure 2:
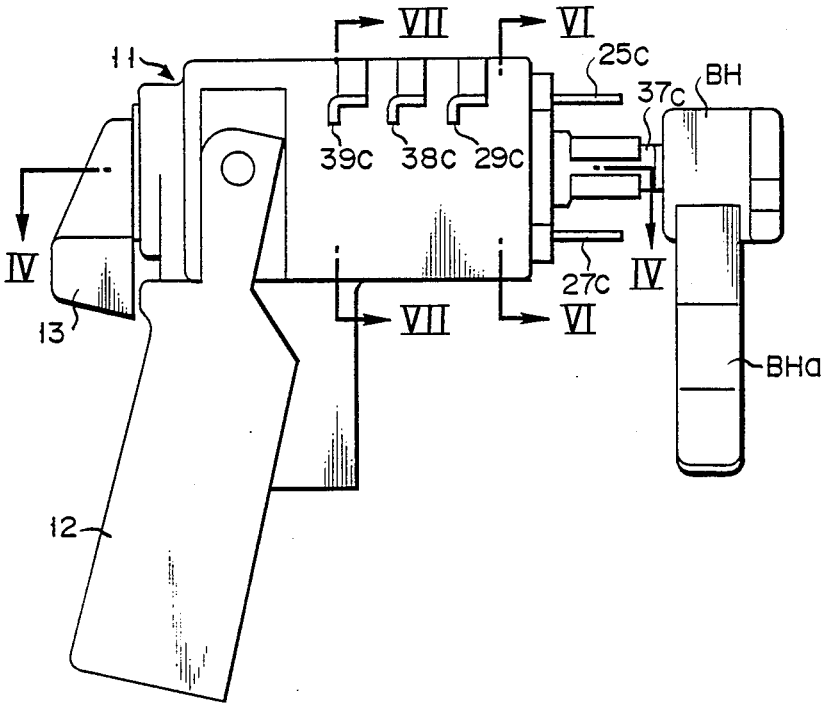
FIG. 2 is a side view of the reversing speed control switch.
Figure 3:
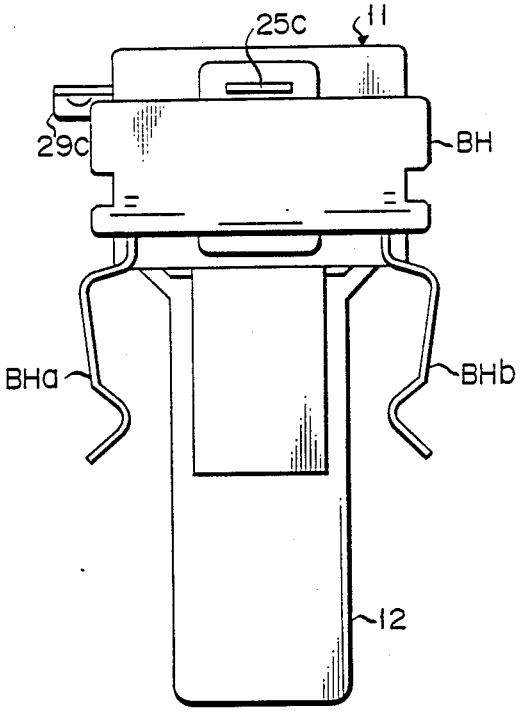
FIG. 3 is a rear view of the reversing speed control switch.
Figure 4:
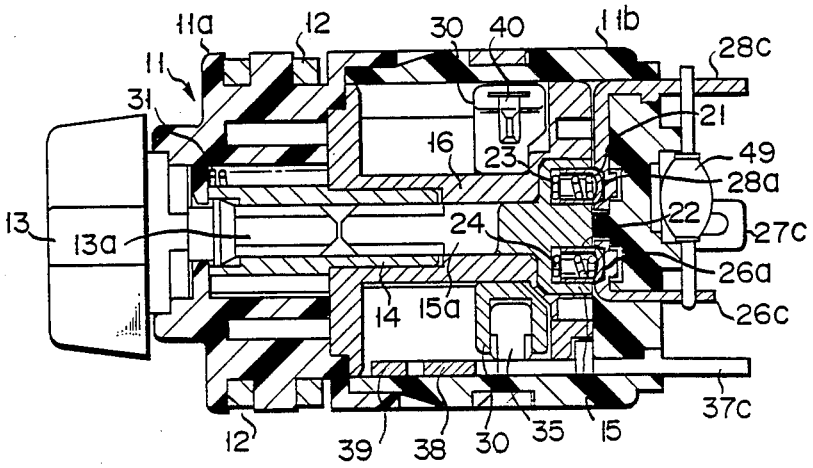
FIG. 4 is a sectional view taken along line IV—IV in FIG. 2.
Figure 5:
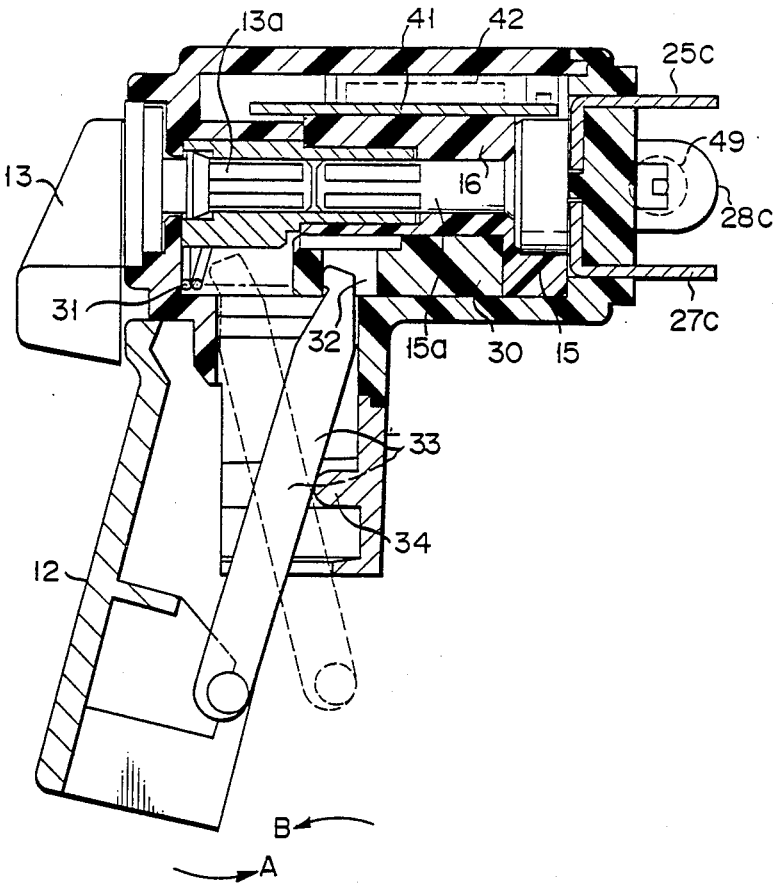
FIG. 5 is a sectional view taken along line V—V in FIG. 1.

Referring to FIGS. 1 to 5, a switch casing 11 is constituted by a first casing 11*a* and a second casing 11*b* (FIG. 4). One end portion of a trigger 12 is pivotally supported on a side portion of the first casing 11*a*. Shaft 13*a* of a reversing actuator 13 for switching the rotating direction of a motor is pivotally supported on the front portion of first casing 11*a*. Connecting terminals 38*c* and 39*c* (FIGS. 1 and 2) formed integrally with stationary contacts 38 and 39 (in FIG. 4, to be described later) and connecting terminal 29*c* (FIGS. 1 to 3) formed integrally with contact 29 (in FIG. 4, to be described later) are arranged on the side portion of second casing 11*b*. Connecting terminals 25*c* (FIGS. 1 to 3, and 5), 26*c* (FIGS. 1 and 4), 27*c* (FIGS. 2, 4 and 5), and 28*c* (FIGS. 1, 4 and 5) formed integrally with stationary contacts 25, 26, 27, and 28 (in FIG. 6 to be described later) are arranged on the rear portion of casing 11. Battery holder BH is provided with connecting terminals BHa and BHb (FIGS. 1 to 3). Terminals BHa and BHb are connected to connecting terminals 28*c* and 37*c* (FIGS. 1 and 4), and are connected to the positive and negative terminals of a battery (not shown). Connecting terminals 26*c* and 28*c* are connected across a diode 49 (FIGS. 1, 4 and 5).

Figure 6:
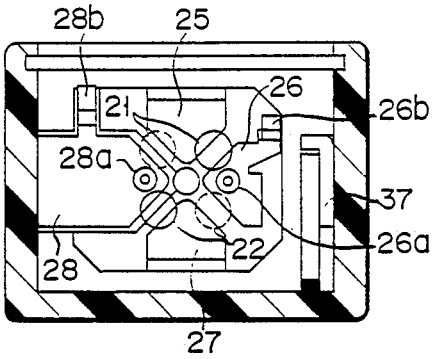
FIG. 6 is a sectional view taken along line VI—VI in FIG. 2.

As is shown in FIGS. 4 and 5, shaft 13*a* of the reversing actuator 13 is coupled to shaft 15*a* of rotor 15, via coupling member 14. Rotor 15 pivotally extends through holding member 16 inside the second casing ll*b*, to be held in position thereby. As is shown in FIG. 4, movable contacts 21 and 22 are movably buried in the end face of rotor 15. Movable contacts 21 and 22 are biased, by coil springs 23 and 24 arranged therein, to project from rotor 15. As can be seen in FIG. 6, stationary contacts 25, 26, 27, and 28 are arranged, at equal intervals along the inner surface portion of second casing 11*b*, facing movable contacts 21 and 22. Movable contacts 21 and 22 can be selectively brought into contact with contacts 25 to 28 upon actuation of reversing actuator 13, as is indicated by solid lines or dotted lines. Movable contacts 21 and 22 and stationary contacts 25 to 28 constitute a reversing switch mechanism.

As is shown in FIGS. 4 and 6, recess portions 26*a* and 28*a* are formed in stationary contacts 26 and 28. The distal end portions of movable contacts 21 and 22 are inserted in or removed from recess portions 26*a* and 28*a* upon actuation of reversing actuator 13, generating a click sound when this occurs.

As can be seen in FIGS. 4 and 5, movable element 30, guided by casing 11*b* and holding member 16, is arranged in second casing 11*b*, to be movable along the longitudinal direction of rotor 15. Spring 31 is interposed between the end face of movable element 30 on the side of first casing 11*a* and the inner surface of first casing 11*a*, such that movable element 30 is biased toward stationary contacts 25 to 28. Engaging portion 32 is formed on the end portion of movable element 30 on the side of first casing 11*a*, and is engaged with one end portion of driving element 33. The other end of driving element 33 is pivotally held by trigger 12, and its intermediate portion abuts against supporting portion 34 formed on the lower portion of first casing 11*a*. Therefore, when trigger 12 is operated in the direction indicated by arrow A as shown in FIG. 5, driving element 33 is pivoted about supporting portion 34, in the direction indicated by arrow B, and movable element 30 is moved toward first casing 11*a*, accordingly.

Figure 7:
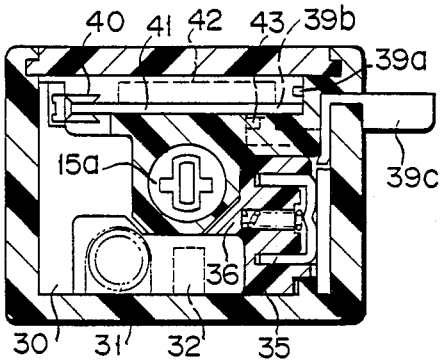
FIG. 7 is a sectional view taken along line VII—VII in FIG. 2.
Figure 8:
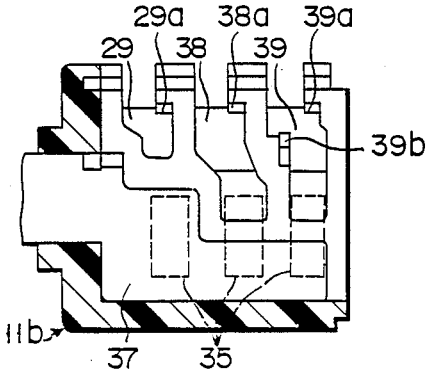
FIG. 8 is a partially cutaway sectional view showing a switch mechanism.

As is shown in FIGS. 4 and 7, movable contact 35 is movably held on one side portion of movable element 30. Movable contact 35 is biased toward the inner surface of second casing 11*b* by spring 36 buried in movable element 30. As can be seen in FIG. 8, common contact 37, stationary contacts 38 and 39, and contact 29 are disposed on the inner surface of second casing 11*b*, and common contact 37 and stationary contacts 38 and 39 are selectively connected to movable contact 35, upon operation of movable element 30.

As is shown in FIGS. 4 and 7, contact element 40 is arranged on the other side portion of movable element 30. Contact element 40 is in movable contact with resistor 68 (to be described later) of circuit board 41 arranged on the upper surface portion of holding member 16.

Figure 9:
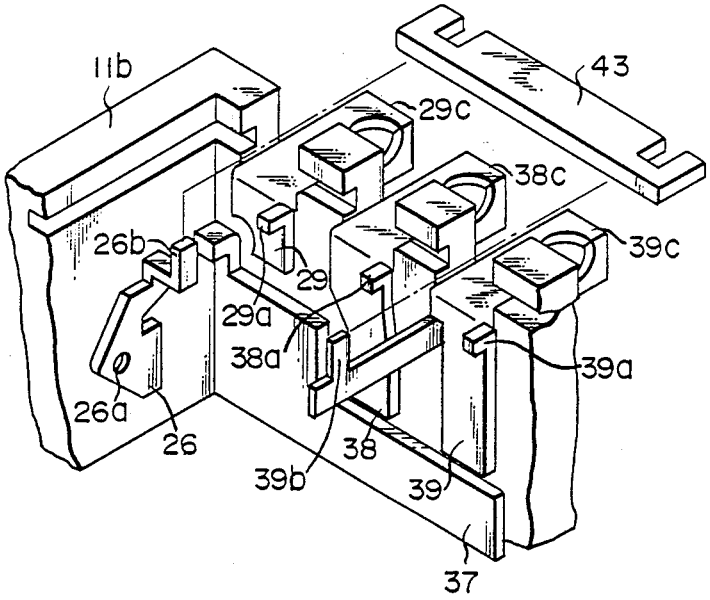
FIG. 9 is a perspective view showing a short-circuiting member.
Figure 10:
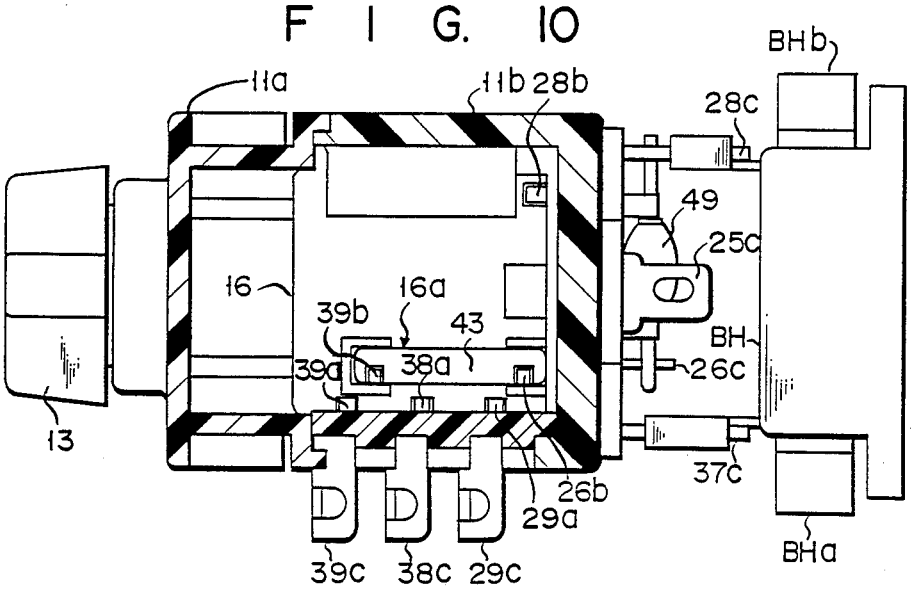
FIG. 10 is a plan view of the short-circuiting member.

As is shown in FIGS. 8, 9, and 10, projections 38*a*, 39*a*, and 29*a* are arranged on stationary contacts 38 and 39 and on the side surface portion of contact 29 inside second casing 11*b*. Projections 38*a*, 39*a*, and 29*a* project from the upper surface portion of holding member while member 16 is stored in casing 11*b*, so as to be connected to a predetermined circuit pattern of circuit board 41.

Figure 11:
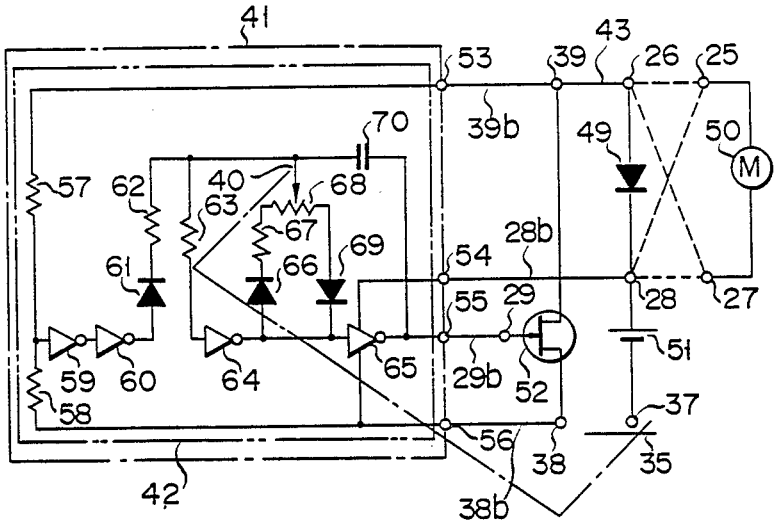
FIG. 11 is a circuit diagram showing a speed control circuit.

Stationary contact 39 constituting a switch mechanism and stationary contact 26 constituting the reversing switch mechanism respectively have projections 39*b* and 26*b*. Projections 39*b* and 26*b* are arranged in recess portion 16*a* formed in holding member 16, while holding member 16 is situated in second casing 11*b*. In this state, projections 39*b* and 26*b* are connected to short-circuiting member 43, as is shown in FIG. 11.

The assembly of this trigger switch will now be described.

(1) Reversing actuator 13 is assembled in first casing 11*a*.

(2) Movable element 30 with movable contact 35 is stored in second casing 11*b* in which stationary contacts 25 to 28 constituting a reversing switch mechanism, and common contact 37, stationary contacts 38 and 39, and contact 29 constituting a switching mechanism are arranged.

(3) Rotor 15 assembled with movable contacts 21 and 22 is assembled in holding member 16, and this assembly is assembled in second casing 11*b*.

(4) Projections 26*b* and 39*b* of stationary contacts 26 and 39 are connected by short-circuiting member 43, both projections being soldered thereto.

(5) Circuit board 41 assembled with contact element 40 is located on holding member 16, and the patterns of circuit board 41 are connected, by means of soldering, to projections 28*b*, 38*b*, 39*b*, and 29*b* of stationary contacts 28, 38, and 39, and contact 29.

(6) Spring 31 and coupling member 14 are assembled in movable element 30 and holding member 16.

(7) First casing 11*a* is bonded to second casing 11*b*, after assembly steps (2) to (6).

(8) Driving element 33 and trigger 12 are assembled in first casing 11*a*, thereby completing the assembly.

Control circuit 42 provided on circuit board 41, and a connecting state between control circuit 42 and the stationary contacts will now be described, with reference to FIG. 11. The same reference numerals in FIG. 11 denote the same parts as in FIGS. 1 to 10.

Referring to FIG. 11, motor 50 is connected between stationary contacts 25 and 27 (connecting terminals 25*c* and 27*c*), and diode 49 is connected between stationary contacts 26 and 28 (connecting terminals 26*c* and 28*c*). Battery 51 is connected between stationary contact 28 and common contact 37, in the direction shown in FIG. 11, and stationary contacts 26 and 39 (projections 26*b* and 39*b*) are connected by short-circuiting member 43. The drain and source electrodes of FET (Field-Effect Transistor) 52 are respectively connected between stationary contacts 39 and 38 (connecting terminals 39*c* and 38*c*). The gate electrode of FET 52 is connected to stationary contact 29 (connecting terminal 29*c*). Stationary contacts 39, 28, 29, and 38 are connected to circuit patterns 53, 54, 55, and 56 of control circuit 42 constituting an oscillator, through projections 39*b*, 28*b*, 29*b*, and 38*b*, respectively. Resistors 57 and 58 are series-connected between patterns 53 and 56. Inverter circuits 59 and 60, diode 61, resistors 62 and 63, and inverter circuits 64 and 65 are series-connected between the node between resistors 57 and 58 and pattern 55, in the order mentioned. A series circuit consisting of diode 66, resistors 67 and 68, and diode 69 is parallel-connected between inverter circuits 64 and 65. Capacitor 70 and contact element 40, which is in contact with resistor 68, and which constitutes a variable resistor, are connected between the node between resistors 62 and 63, and pattern 55.

In the above arrangement, when reversing actuator 13 is actuated to connect stationary contacts 25, 26, 27, and 28, as indicated by the solid line in FIG. 6, motor 50 is rotated in the forward direction. When reversing actuator 13 is operated to connect stationary contacts 25, 28, 26, and 27, as indicated by the dotted line in FIG. 6, motor 50 is rotated in the reverse direction.

In the state where reversing actuator 13 is appropriately operated, when trigger 12 is operated, common contact 37 and stationary contact 38 are connected to each other by movable contact 35, upon movement of movable element 30. Then, control circuit 42 is powered to perform oscillation. A pulse signal output from control circuit 42 is supplied to the gate of FET 52, to allow the switching operation thereof. In this state, when trigger 12 is withdrawn further, contact element 40 slides along resistor 68, while common contact 37 and stationary contact 38 are connected to each other by movable contact 35. Thus, the duty ratio of the pulse signal output from control circuit 42 is gradually increased, and power supplied to FET 52 increases. Therefore, the rotating speed of motor 50 increases accordingly. When trigger 12 is withdrawn to its limit, common contact 37 and stationary contact 39 are connected by movable contact 35, and maximum power is fed to motor 50, thus rotating motor 50 at maximum speed.

When the actuation force of trigger 12 is weakened from this state, movable element 30 and trigger 12 are returned by the biasing force of spring 31. Upon this movement, movable contact 35 and contact element 40 are operated in the reverse direction, as is described above, and the rotating speed of motor 50 is decreased. When trigger 12 is returned to the position shown in FIG. 1 or 5, motor 50 is stopped.

With the above embodiment, the following effects can be obtained:

The switch mechanism for turning the power source on and off, the reversing switch mechanism for switching the polarity of the output voltage, and the speed control circuit are arranged around holding member 16 inside the switch casing. Therefore, since the power switch mechanism, the reversing switch mechanism, and the speed control circuit have good space efficiency, the switch casing can be rendered compact.

The reversing switch mechanism and the power switch mechanism are arranged on adjacent inner surfaces of switch casing 11, and the speed control circuit is arranged on the surface perpendicular thereto. Therefore, the speed control circuit, the reversing switch mechanism, and the power switch mechanism can be arranged adjacent to each other, resulting in ease of electrical connection therebetween.

Furthermore, in stationary contacts 26 and 39, their projections **26*b* and 39*b* are connected by short-circuiting member 43**. Therefore, assembly this reversing speed control switch is quite easy.

Connections between stationary contacts 39, 28, 29, and 38 and circuit patterns 53, 54, 55, and 56 of circuit board 41 are performed through projections **39*b*, 28*b*, 29*b*, and 38*b***, respectively, resulting in easy assembly thereof.

Another embodiment of the present invention will now be described. The same reference numerals in this embodiment denote the same parts as in FIGS. 1 to 10.

Figure 12:
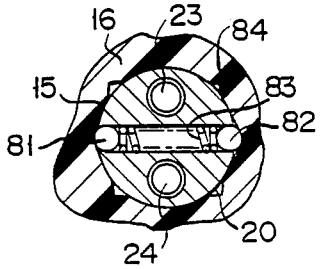
FIG. 12 is a sectional view showing the main part of a rotor according to a second embodiment of the present invention.

FIG. 12 shows a modification of rotor 15. Steel balls 81 and 82 are buried in the end portion of rotor 15, and are biased toward the inner surface portion of holding member 16, by means of spring 83 arranged therebetween. A plurality of cams 84 are formed on the inner surface portion of holding member 16, as is shown in FIG. 12. Steel balls 81 and 82 are urged against cams 84. Therefore, when reversing actuator 13 is pivoted, rotor 15 is driven upon operation of steel balls 81 and 82 and cams 84.

Figure 13:
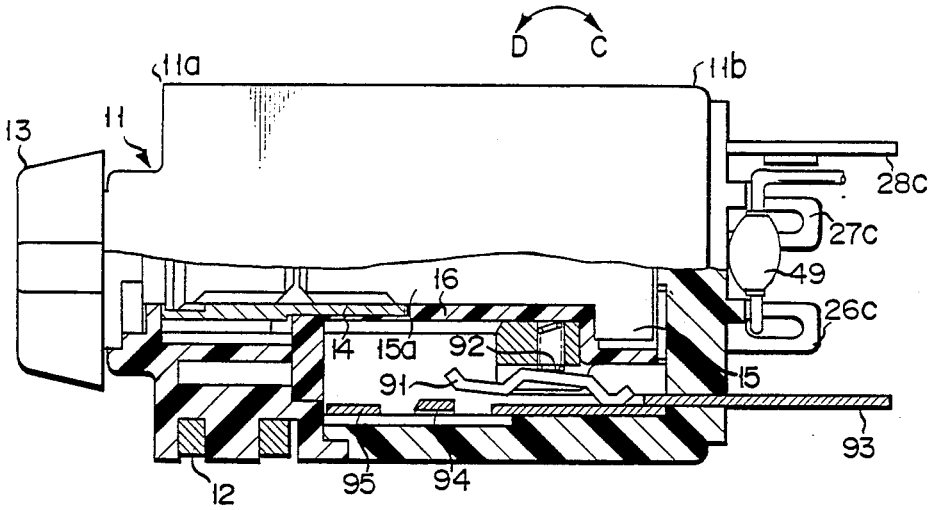
FIG. 13 is a partially cutaway plan view showing a reversing speed control switch mechanism according to a third embodiment of the present invention.
Figure 14:
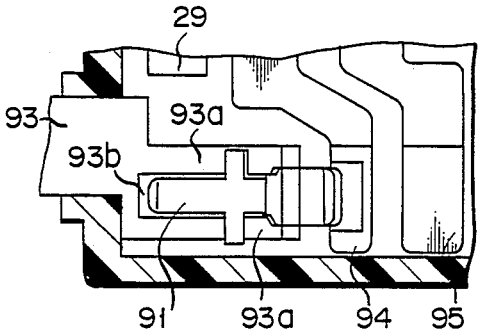
FIG. 14 is a front view showing the main part of the power switch mechanism of FIG. 13.

FIGS. 13 and 14 show a modification of the switch mechanism of the present invention. Movable contact 91 is arranged on movable element 30. Movable contact 91 is biased toward the inner surface of second casing **11*b* by means of spring 92 buried in movable element 30. Common contact 93 and stationary contacts 94 and 95 are disposed on the inner surface of second casing 11*b*. Stepped portion 93*a* along which one end portion of movable contact 91 slides and recess portion 93*b* which can store the other end portion of movable contact 91 are arranged on common contact 93. When movable element 30 is located at a position shown in FIG. 4 or 5, one end portion of movable contact 91 is located on stepped portion 93*a*, and the other end portion thereof is located in recess portion 93*b*. Therefore, movable contact 91 is pivoted in the direction indicated by arrow C, and one end portion of movable contact 93 is separated from stationary contact 94. When movable element 30 is moved toward first casing 11*a* upon operation of trigger 12, one end portion of movable contact 91 is separated from stepped portion 93*a*, and movable contact 91 is pivoted in the direction indicated by arrow D. For this reason, one end portion of movable contact 91 is sequentially brought into contact with stationary contacts 94 and 95 while the other end portion thereof is in contact with common contact 93**.

When the operating force of trigger 12 is released, an operation the reverse of the above description is performed.

The present invention is not limited to the above embodiments, and various other changes and modifications may be made within the spirit and scope of the invention.

What is claimed is:

1. A reversing speed control switch comprising:

a casing;

a holding member within the casing;

movable element means within the casing for movement linearly along the holding member;

trigger actuation means outside the casing for so moving the movable element means;

power switch means having a plurality of first stationary contacts on an inner, side surface of the casing and a first movable contact on the movable element means selectively movable into contact with one of the first stationary contacts upon the movement of the movable element means for switching a power source connected to the first stationary contacts on and off in response the movement of the movable element means;

reversing actuating means having a shaft rotatably extending through the holding member and an actuator outside the casing to rotate the shaft;

reversing switch means having at least one second movable contact on an inner end face of the shaft and a plurality of second stationary contacts opposing the end face of the shaft on an inner, end surface of the casing adjacent to the inner, side surface of the casing with the plurality of first stationary contacts, the second stationary contacts being connected to the first stationary contacts for reversing the polarity of power switched on by the power switch means; and speed control means operative between the movable element means and the holding member and connected to the first and second stationary contacts for controlling the power reversibly switched on thereby in accordance with the movement of the movable element means, whereby to provide speed control.

2. The reversing speed control switch according to claim 1, wherein the speed control means comprises a speed control circuit including a variable resistor and a slider movable relative thereto by the movable element means.

3. The reversing speed control switch according to claim 1, wherein the first and second stationary contacts include a projection extending into the holding member and connected to a short-circuiting member.

4. The reversing speed control switch according to claim 1, wherein the second movable contact is movable into and out of recesses respectively in the second stationary contacts.

5. The reversing speed control switch according to claim 1, wherein the shaft has a storage hole and the reversing actuating means further comprises steel balls, a spring for urging the steel balls in a direction away from the storage hole and cam means on an inner surface of the holding member for engaging one of the steel balls with the storage hole.

* * * * *